US005904443A

United States Patent [19]

Soleau

[11] Patent Number: 5,904,443

[45] Date of Patent: May 18, 1999

[54] TIRE DEFLATING MECHANISM AND METHOD

[75] Inventor: Bert Soleau, Fairfax, Va.

[73] Assignee: Eagle Research Group, Inc., Arlington, Va.

[21] Appl. No.: 08/933,310

[22] Filed: Sep. 18, 1997

Related U.S. Application Data

[ 60] Provisional application No. 60/027,482, Sep. 25, 1996.

[51] Int. Cl.[6] ..... E01F 13/00

[52] U.S. Cl. ..... 404/6

[58] Field of Search ..... 404/6, 9, 10, 11, 404/12, 15; 256/1, 13.1, 18; 102/221, 262, 265, 439, 293, 344, 345; 89/1.11, 1.14; 409/6, 9–12, 15

[56] References Cited

U.S. PATENT DOCUMENTS

| | | | |
|---|---|---|---|
| 4,318,079 | 3/1982 | Dickinson | 404/6 X |
| 4,576,508 | 3/1986 | Dickinson | 404/6 |
| 4,577,991 | 3/1986 | Rolow . | |
| 4,711,608 | 12/1987 | Ghusn . | |
| 5,253,950 | 10/1993 | Kilgrow et al. | 404/6 |
| 5,322,385 | 6/1994 | Reisman . | |
| 5,482,397 | 1/1996 | Soleau . | |
| 5,498,102 | 3/1996 | Bissell | 404/6 |
| 5,507,588 | 4/1996 | Marts et al. . | |
| 5,536,109 | 7/1996 | Lowndes | 404/6 |
| 5,557,059 | 9/1996 | Warren et al. . | |
| 5,611,408 | 3/1997 | Abukhader . | |

FOREIGN PATENT DOCUMENTS

| | | | |
|---|---|---|---|
| 2 552 793 | 4/1985 | France . | |
| 2604654 | 4/1988 | France | 404/6 |
| 575238 | 4/1933 | Germany . | |
| 206470 | 1/1964 | Sweden . | |
| 2 210 091 | 6/1989 | United Kingdom . | |

*Primary Examiner*—Tamara Graysay
*Assistant Examiner*—Sunil Singh
*Attorney, Agent, or Firm*—Oblon, Spivak, McClelland, Maier & Neustadt, P.C.

[57] ABSTRACT

A tire deflator and method of deflating a tire includes at least one support, a tire deflating device detachably secured to the at least one support and a deploying mechanism cooperating with the support and deploying the spike so as to be projected toward the tire of the vehicle and to penetrate and deflate the tire. The method of deflating the tire includes the steps of detachably securing a tire deflating device to the support, positioning the deploying mechanism in proximity with the support and activating the deploying mechanism so as to deploy the tire deflating device into the tire and deflate the tire. The degree to which the tire deflating device is deployed can be limited so that the tire deflating device does not become dislodged from a moving tire after being penetrated by the tire deflating device and thus does not create the potential of striking a bystander.

12 Claims, 4 Drawing Sheets

TIRE DEFLATING MECHANISM AND METHOD

This application claims the benefit of U.S. Provisional Application Ser. No. 60/027,482, filed Sep. 25, 1996.

BACKGROUND OF THE INVENTION

1. Field of the Invention

The present invention is based on U.S. Provisional Application No. 60/027,482, filed Sep. 25, 1996, which is directed to a tire deflating mechanism and method wherein a nonlethal, buried device is capable of deflating pneumatic tires by driving hollow steel spikes through the tire treads of a target vehicle. The method and apparatus uses pyrotechnic gas generators or gunpowder to propel spikes from sheaths through a thin layer of soil and into the tire carcass so as to eliminate the blast effect of conventional anti-vehicle mines so as to be useful for establishing anti-vehicle perimeters around military bases and other sensitive areas. The movement of the spike can be limited by the use of cooperating tubes or pistons forming the support for the spike or by the utilization of a short tether on each spike which limits the range of spikes not encountering the tire, while those that penetrate a tire will be pneumatically released from their connection with a support. Spikes that are tethered are releasable from their tethers by air pressure within the tire in a first embodiment. The present invention permits a spike to be impaled in a tire to separate and rotate with the tire, while those not encountering a tire will pose no danger beyond a distance approximately 6 inches above the ground. The interengaging tubes of the second embodiment versus the utilization of the tethers in the first embodiment serves to reduce the possibility of injuries to bystanders from flying spikes while retaining an effective tire deflating capability.

2. Discussion of the Background

Tire deflating mechanisms are known, for example, from U.S. Pat. No. 5,482,397, the disclosure of which is incorporated by reference, which is directed to a tire deflator and method of deflating a tire of a moving vehicle that includes at least one support mechanism and a spike secured to the at least one support mechanism such that upon the tire of the moving vehicle being penetrated by the spike, both the spike and support mechanism rotate with the tire so as to allow for a rapid air depletion of the tire. The method shown therein includes the steps of securing the spike to the at least one support mechanism, positioning the support mechanism in a roadway and penetrating the tire with a spike such that the spike and support mechanism as an integral unit becomes secured to the tire and rotate with the tire after the tire is penetrated by the spike.

Other arrangements for deflating a tire include deployable vehicle barricades as shown in U.S. Pat. No. 4,577,991 and a retractable barrier strip as shown in U.S. Pat. No. 5,507,588, the disclosure of each of which is also incorporated herein by reference. Another road barrier preventing passage of vehicles is characterized by French Patent 2552793 which comprises a set of retractable spikes mounted on a rotatable shaft underneath the road surface. Such structure is, however, complicated in terms of the number of elements required and the manner of operation thereof which includes the need for a double action jack which operates hydraulically, pneumatically or electrically, and which must be situated in a channel in the ground.

SUMMARY OF THE INVENTION

An object of the present invention is to overcome the drawbacks of the prior art discussed above by providing an effective tire deflating mechanism and method which is simple in construction and safe for operation. The purpose of the present invention is to provide the capability of nonlethally disabling vehicles equipped with pneumatic tires without collateral damage generated by high explosive land mines. Applications of the present invention include counter terrorist perimeter defenses as well as use in peace keeping missions where roadway denial by conventional mines would result in death or serious injury to noncombatants or even friendly or allied forces inadvertently using such roadways. Nonlethal buried tire deflators would effectively shut down a road or perimeter to vehicular traffic without posing a lethal threat to nonbeligerants or friendly/allied forces either in vehicles or on foot.

DESCRIPTION OF THE PREFERRED EMBODIMENTS

Figure 1:
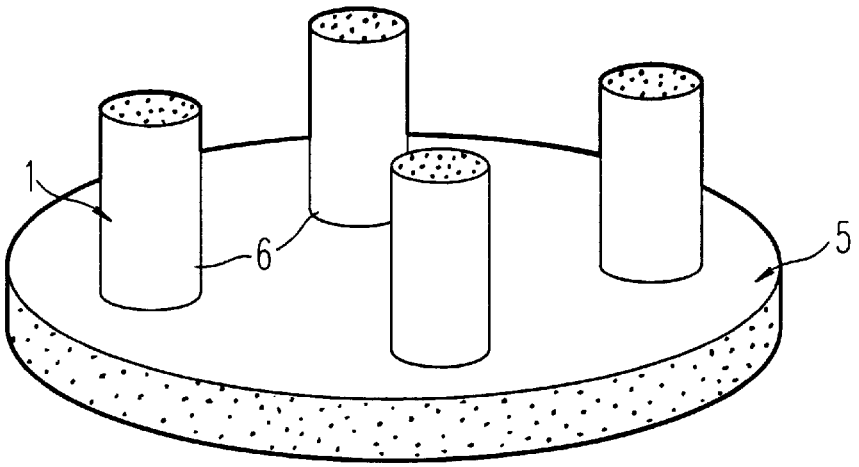
FIG. 1 shows a first embodiment of a nonlethal, tire deflating mechanism.

The present invention is directed to the utilization of an apparatus and method for impaling a tire with a spike so as to provide an unobstructed airway through the tire and thus deflate the tire. The spikes utilized in accordance with the present invention remain extended through the tire carcass to provide a free-flowing air path for rapid deflation and to overcome the drawbacks of conventional anti-leak compounds and designs. Tires penetrated by spikes of this type are irreparable. In a buried tire deflator application in accordance with the present invention, shallowly buried spikes 1 are propelled from sheaths 6 through the soil layer and into a tire. A flange 2 at the base of the spike ensures that the entire spike does not continue through the tire into its interior but extends through its tread and carcass to assure rapid deflation. A hardened steel spike tip with a sloped, chiseled cutting edge has been tested and found to be effective in deflating tires. The design incorporates radial holes in the follow spike to facilitate air loss, offers the best combination of features for penetrating both soil and tires, and is an acceptable candidate for use in non-lethal buried tire deflators.

An ammonium nitrate base propellant or gun powder 3 that burns rapidly or undergoes combustion as indicated by reference number 9, but does not detonate, can supply, for example, the motive force for the spike although other propellants are possible. Tests have been performed to identify the velocity required for a given spike design to penetrate various soils and tires of interest, and an initial estimate of 400 to 600 feet per second appears realistic. The velocities in this range are easily achievable for the spike at reasonable pressures, e.g. 10 k psi, and a tube length of approximately 2 inches.

Spike 1 is tethered by tether 4 to a base plate 5 of a support sheath 6 to limit its range to about 6 inches above the solid surface 7. This greatly reduces the possibility of injury to noncombatants in close proximity to the vehicle being interdicted, and prevents spike penetration into the vehicle's passenger compartment. It is, however, desired that spikes penetrating a tire to be free to rotate with the tire to provide an airway for rapid deflation. This is achieved by incorporating a pneumatic tether release in each spike that is actuated by a higher than ambient air pressure within the tire. The tether serves to interconnect the sheath to the base 2 of the spike.

Fusing and firing mechanisms used on conventional high explosive anti-vehicle mines are adaptable for use in the buried tire deflator of the present invention. An optional feature of the non-lethal mine in accordance with the present invention is the incorporation of an Identification Friend or Foe (IFF) sensor to disarm the mine and permit unfettered passage of friendly vehicles while denying a roadway or perimeter to unauthorized vehicles. This is feasible with the buriable tire deflators of the present invention where the consequences of a malfunction in IFF is deflated tires. With a conventional high explosive mine, IFF failure can result in the maiming or death of friendly personnel so as to thus constitute an unacceptable risk.

Clearing and rendering the buriable tire deflator safe will be less hazardous than for conventional mines. Two events will occur when the buriable tire deflator is fired: (1) the spikes 1 exit an array at the top of the mine and travel for approximately 6 inches prior to being halted by their tethers 4; and (2) propelling gases exit the spike sheaths 6. For complete safety, a person rendering the mine safe merely has to be trained to keep all parts of his/her body from being in front of the spike sheaths and to use normally available safety masks to protect their face from the exiting propellant gas. It is anticipated that the exiting gas will approximate the hazard normally posed by the muzzle blast, not the projectiles, of a 12 gauge shot gun and thus constitute a very manageable risk.

Because the nonlethal roadway denial device of the present invention is buried below ground level 7, it cannot be readily observed and thus be avoided by an intruder. The non-lethal roadway denial devices can, for example, be in a continuously armed state, or be remotely armed by a detector mechanism detecting the presence of the vehicle, as would be understood by one of ordinary skill in the art, once an intrusion is detected or suspected. In permanent security arrangements, an emplaced nonlethal roadway denial device could be positively armed and disarmed by a hard wired link and be activated remotely, for example. Antipersonnel applications can also be considered for use with the present invention.

The nonlethal roadway denial device configuration is not restricted to the diameter shown in the present application which would normally be of an 8 inch diameter. A large circular array or linear array may be more effective in some applications. In addition, polymeric and ceramic materials can also be extensively used to reduce magnetic signatures of the tire deflating mechanism of the present invention.

Figure 2:
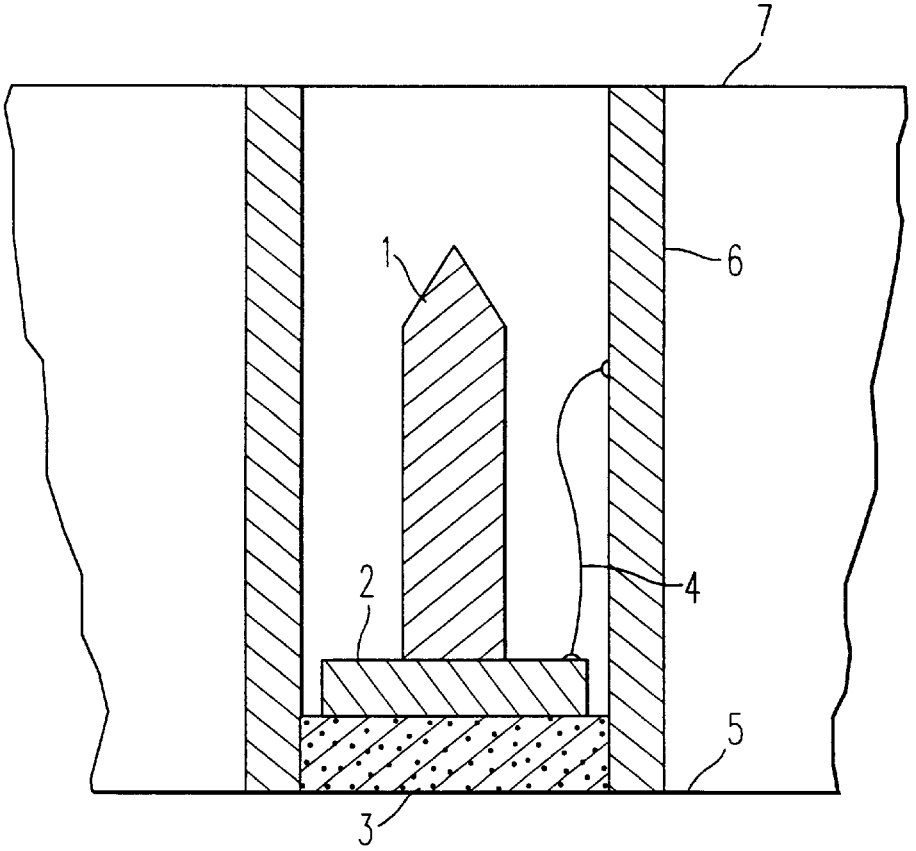
FIG. 2 shows a cross section of the spike sheath which includes the spike and a propellant which is utilized in the embodiment shown in FIG. 1.
Figure 3:
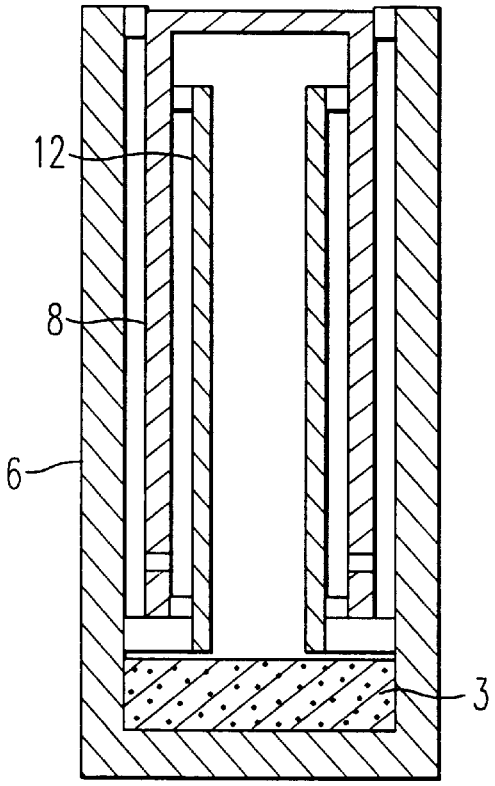
FIG. 3 is a cross sectional view of a second embodiment of the present invention which utilizes a spike positioned on top of an uppermost piston or tube and which shows the same in an inactive position.
Figure 4:
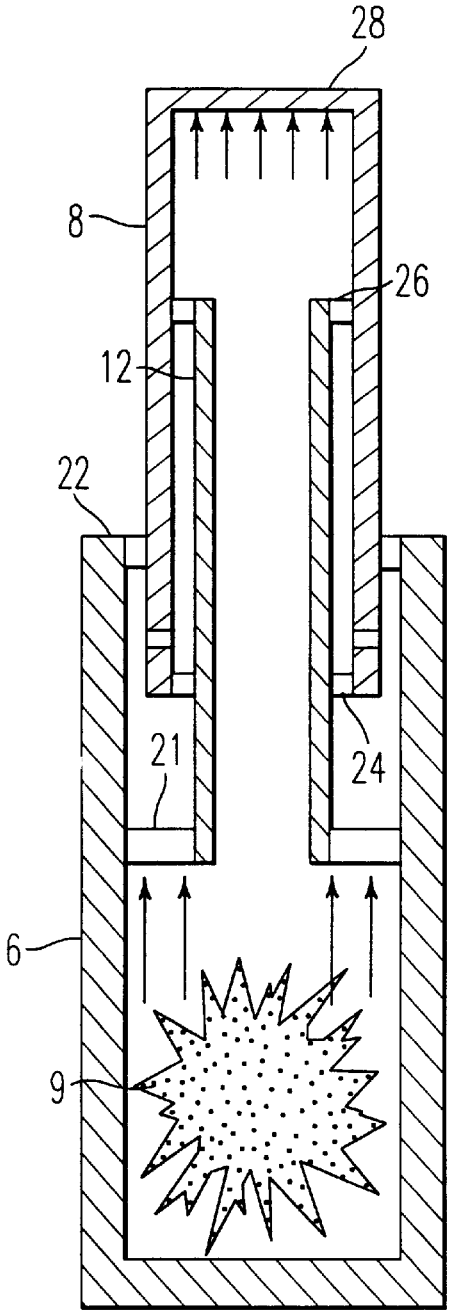
FIG. 4 shows the structure of FIG. 3 when activated.
Figure 5:
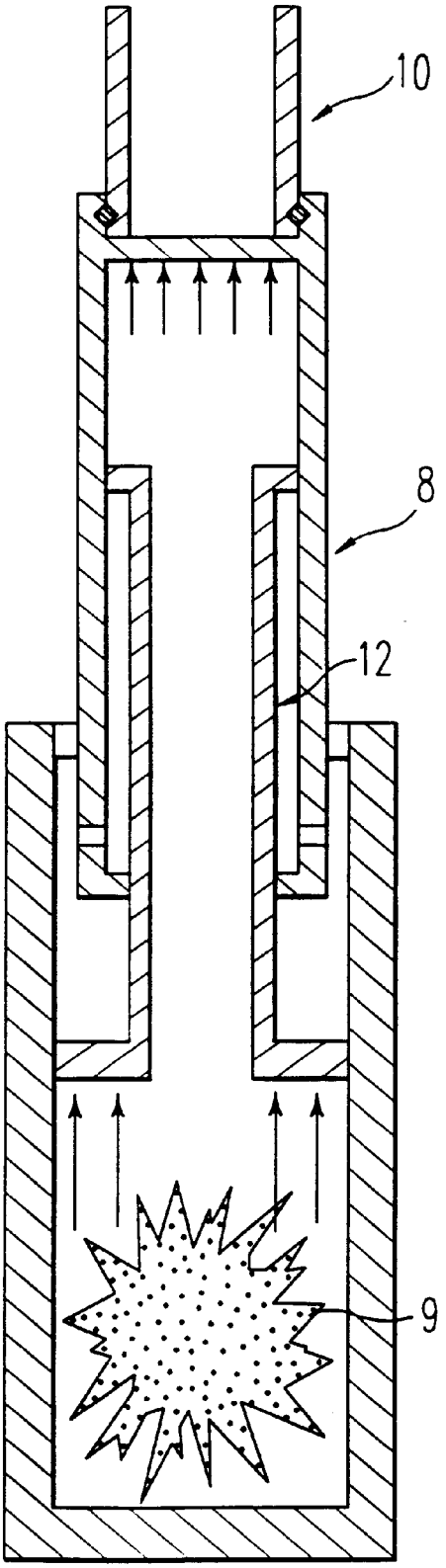
FIG. 5 shows the structure of FIG. 4 wherein a spike is mounted on an upper portion of the uppermost tube or piston.
Figure 6:
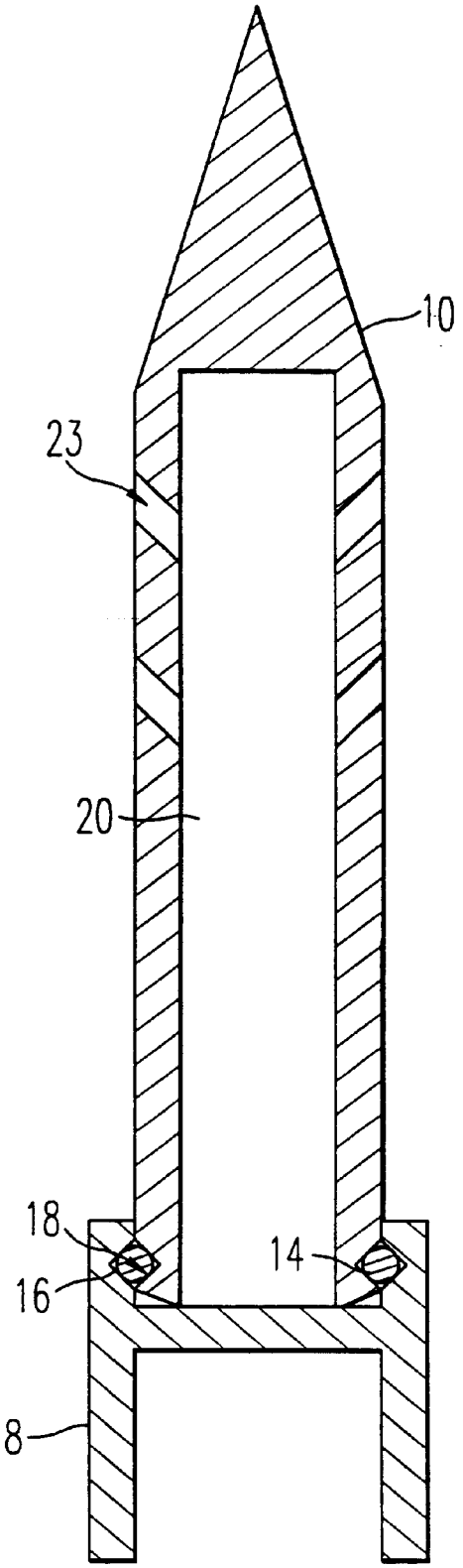
FIG. 6 shows details of the interconnection of the spike with the upper tube or piston.
Figure 7:
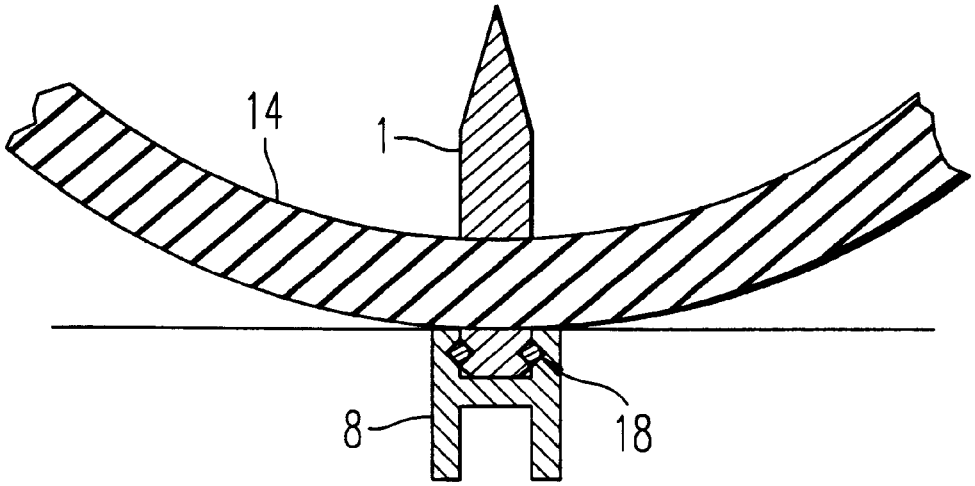
FIG. 7 shows the manner in which the spike penetrates the tire.

A second embodiment of the present invention is shown in FIGS. 3–8. As shown therein, an extendable hollow tube or piston 8 with a spike 10 affixed to the top portion thereof provides a viable alternative to the embodiment shown in FIGS. 1 and 2 which shoots the spikes into the tires. Instead, the present embodiment permits for a breakaway type spike to be attached to the top of the hollow tube or piston 8 and can be utilized in the manner shown in FIGS. 3–8. This embodiment utilizes sheath 6, tube 8 and a telescoping tube or piston 12 which interconnects the spike 10 and tube 8. Peak velocities and pressures will be lower in this embodiment as compared with the first embodiment and the spike 10 will be retained on the expandable piston or tube 8 until torqued off by an impaled tire. As in the first embodiment, the spike 10 that penetrates the tire will separate from the deflator so as to remain in the tire and provide an unobstructed airway for rapid deflation. FIGS. 3–8 depict both the mechanism and method of deployment in accordance with the present invention.

Figure 8:
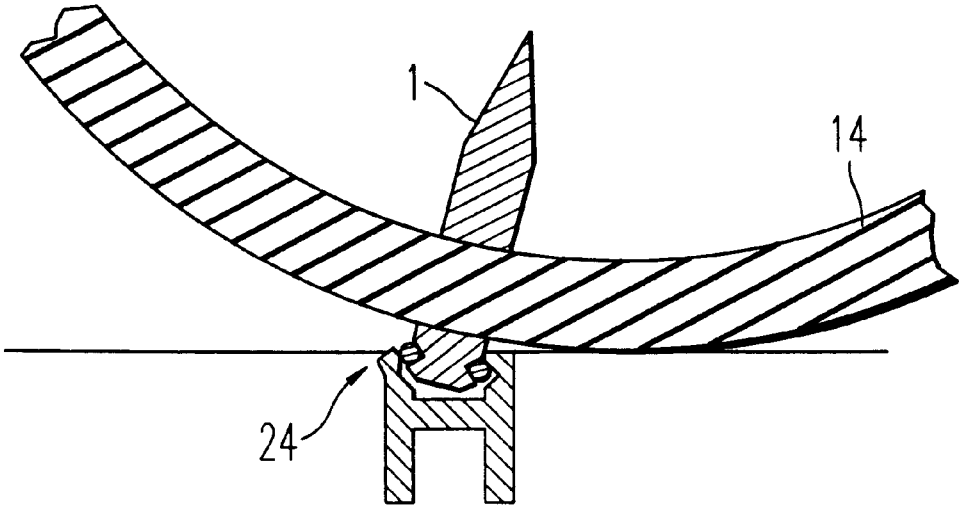
FIG. 8 shows the manner in which the breakaway cup structure of the upper tube or piston operates with respect to the spike so as to permit the spike to be carried away by the tire.

As shown in FIGS. 3–8, grooves 14, 16 may respectively be provided in the spike 10 and the tube/piston 8 for housing therebetween an O-ring 18 to temporarily hold the spike until being pulled off. The spike may have a hollow axial portion 20 and be provided with a plurality of radial vent holes 23. Grooves 14, 16 form a breakaway cup 24 which is breakable when the tire is penetrated by the hollow spike 10 and the cup is then broken by the rotating tire as shown in FIG. 8. This permits the spike to be retained in the tire and permit rapid deflation by air passing into vent holes 23 and out of hollow axial projection 20. Activation of the spike 10 is by, for example, exploding the propellant 3 as shown in FIGS. 3–8. Sheath 6, tube/piston 8 and telescoping tube/piston 12 are provided with stop flanges 21, 22, 24, 26 which can engage one another in an extended position to prevent tube/piston 8 from being deployed out of the sheath 6. Gases from the propellant 3 are communicated through the tube/piston 8 and act against the end portion 28 of tube/piston 8 to cause it to rise from its initial position in FIG. 3 to its expanded or raised position in FIG. 4.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A tire deflator for deflating a tire of a moving vehicle, which comprises:

at least one support;

a tire deflating device detachably secured to said at least one support; and a deploying mechanism cooperating with said support and explosively propelling said tire deflating device from said support so as to be projected towards the tire of the vehicle and to penetrate the tire, become separated from said support and to deflate the tire.

2. A tire deflator as claimed in claim 1, wherein said tire deflating device is hollow.

3. A tire deflator as claimed in claim 1, which comprises a detaching mechanism which detachably connects said tire deflating device to an end portion of said at least one support.

4. A tire deflator as claimed in claim 1, wherein said at least one support comprises a sheath with at least one of a tube and piston being movably mounted therein.

5. A tire deflator as claimed in claim 1, which comprises a tether mechanism which connects said tire deflating device to said at least one support.

6. A tire deflator as claimed in claim 1, wherein said tire deflating device comprises a spike.

7. A tire deflator as claimed in claim 6, wherein said tire deflating device comprises a hollow axial portion which extends substantially the entire length thereof and through which air from the tire is passable.

8. A tire deflator for deflating a tire of a moving vehicle, which comprises:

at least one support;

a tire deflating device detachably secured to said at least one support; and a deploying mechanism cooperating with said support and deploying said tire deflating device from said support so as to be projected towards the tire of the vehicle and to penetrate and deflate the tire wherein said tire deflating device has a plurality of holes formed in side portions thereof to assist in the flow of air from the tire through the tire deflating device upon penetrating the tire.

9. A tire deflator for deflating a tire of a moving vehicle, which comprises:

at least one support;

a tire deflating device detachably secured to said at least one support; and a deploying mechanism cooperating with said support and deploying said tire deflating device from said support so as to be projected towards the tire of the vehicle and to penetrate and deflate the tire, wherein said deploying mechanism comprises one of a tube and a piston positioned in said at least one support and being movable with respect to said at least one support upon activation of said deploying mechanism.

10. A tire deflator as claimed in claim 9, which comprises a detaching member located at an end portion of said at least one support which detachably interconnects said one of said tube and said piston to said tire deflating device.

11. A method of deflating a tire of a vehicle, which comprises:

detachably securing a tire deflating device to at least one support mechanism;

positioning a deploying mechanism in proximity with said at least one support mechanism;

activating said deploying mechanism; and deploying the tire deflating device and explosively propelling the tire deflating device so as to penetrate the tire, become separated from said at least one support mechanism and to deflate the tire.

12. A method of deflating a tire as claimed in claim 11, which comprises limiting the extent of deploying the tire deflating device upon activating said deploying mechanism.

* * * * *

UNITED STATES PATENT AND TRADEMARK OFFICE

CERTIFICATE OF CORRECTION

PATENT NO. : 5,904,443

DATED : May 18, 1999

INVENTOR(S) : Bert Soleau

It is certified that error appears in the above-identified patent and that said Letters Patent is hereby corrected as shown below:

On the title page, substitute the following Abstract:

A tire deflator and method of deflating a tire includes at least one support, a tire deflating device detachably secured to the at least one support and a deploying mechanism cooperating with the support and deploying the spike so as to be projected toward the tire of the vehicle and to penetrate and deflate the tire. The method of deflating the tire includes the steps of detachably securing a tire deflating device to the support, positioning the deploying mechanism in proximity with the support and activating the deploying mechanism so as to deploy the tire deflating device into the tire and deflate the tire. The degree to which the tire deflating device is deployed can be limited if not contacted by the tire so as to thus not create the potential of striking a bystander.

Signed and Sealed this

Twenty-sixth Day of October, 1999

*Attest:*

Q. TODD DICKINSON

*Attesting Officer*

*Acting Commissioner of Patents and Trademarks*